US009355539B2

(12) United States Patent
Yang

(10) Patent No.: US 9,355,539 B2
(45) Date of Patent: May 31, 2016

(54) ONE TIME USE MULTI-FUNCTION TAG

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 143 days.

(21) Appl. No.: 14/099,788

(22) Filed: Dec. 6, 2013

(65) Prior Publication Data

US 2014/0159902 A1 Jun. 12, 2014

Related U.S. Application Data

(60) Provisional application No. 61/734,478, filed on Dec. 7, 2012.

(51) Int. Cl.
*G08B 13/14* (2006.01)
*G08B 13/24* (2006.01)

(52) U.S. Cl.
CPC ..... *G08B 13/2434* (2013.01)

(58) Field of Classification Search
CPC ..... G06K 19/07749
USPC ..... 340/572.8, 572.9; 70/57.1; 235/492
See application file for complete search history.

(56) References Cited

U.S. PATENT DOCUMENTS 3,942,829 A * 3/1976 Humble ..... E05B 73/0017 70/57.1
4,649,397 A * 3/1987 Heaton ..... E05B 73/0017 116/211
6,023,951 A 2/2000 Maurer et al.
6,339,378 B2 1/2002 Seidel
6,535,130 B2 3/2003 Nguyen et al.
6,724,311 B1 4/2004 Kolton et al.
6,754,939 B2 * 6/2004 Belden, Jr. et al. ..... 24/704.1
7,005,989 B2 2/2006 Benoit et al.
7,073,236 B2 7/2006 Xue et al.
7,148,805 B2 12/2006 Hogan
7,183,917 B2 2/2007 Piccoli et al.
7,400,254 B2 7/2008 Yang et al.
7,474,222 B2 1/2009 Yang et al.
D599,242 S 9/2009 Yang
D624,447 S 9/2010 Yang
7,817,041 B2 10/2010 Skjellerup et al.
7,969,310 B2 6/2011 Sayegh
D649,898 S 12/2011 Yang
8,144,014 B1 3/2012 Yang
8,223,022 B2 7/2012 Skjellerup et al.
8,269,631 B2 9/2012 Yang
8,416,082 B2 4/2013 Sayegh et al.
8,421,633 B2 4/2013 Yang
8,573,011 B2 * 11/2013 Thoonsen ..... 70/57.1
2006/0070410 A1 * 4/2006 Fuss et al. ..... 70/57.1

(Continued)

*Primary Examiner* — Benjamin C Lee
*Assistant Examiner* — Israel Daramola
(74) *Attorney, Agent, or Firm* — Waters Law Group, PLLC; Brian W. Foxworthy; Robert R. Waters

(57) ABSTRACT

An anti-theft tag has two slightly concave shells attached to each other by a hinge. One shell has an aperture through it and the other shell has a post located to insert through the aperture when the two shells are brought together. At least one catch tab extends laterally from the end of the post. The catch tab exceeds the width of the aperture and is constructed to give to allow the post to insert into the aperture, but to resist and prevent the extraction of the post. The post is severable to allow the remove of the catch tab to allow the opening of the tag. One of the shells also has a slot and the other has a tack. When the post is inserted through the aperture, the tack inserts into the slot. The tack passes through an object to be protected and maintains the tag in place.

5 Claims, 4 Drawing Sheets

(56) References Cited

U.S. PATENT DOCUMENTS

2007/0252707 A1* 11/2007 Seidel ..... 340/572.9
2009/0212920 A1 8/2009 Yang
2010/0171621 A1 7/2010 Yang
2010/0214102 A1 8/2010 Yang
2010/0277323 A1* 11/2010 Feibelman et al. ..... 340/572.8
2010/0315237 A1 12/2010 Yang
2011/0227706 A1 9/2011 Yang
2012/0267436 A1* 10/2012 Yang ..... 235/492

* cited by examiner

ONE TIME USE MULTI-FUNCTION TAG

CROSS REFERENCE TO RELATED APPLICATIONS

This application claims priority to U.S. Provisional Application 61/734,478 filed on Dec. 7, 2012. The entirety of U.S. Provisional Application 61/734,478 including both the figures and specification are incorporated herein by reference.

FIELD OF THE INVENTION

This invention relates to the prevention of the fraudulent return of purchased goods. More specifically, this invention relates to the prevention of the return of garments which have been purchased, worn, and then returned to the store after having been worn.

BACKGROUND OF THE INVENTION

Theft of goods in the retail environment is a serious concern. Theft cuts into the margins of a business making it more difficult for a business to compete and succeed. One type of theft is fraudulently returned garments. This type of theft involves purchasing a garment, perhaps a more expensive high end garment, and wearing it at least once. After the garment has been worn, it is fraudulently returned to the retail outlet where it was purchased. This allows the purchaser to get the good of the product without paying for it. This frequently occurs when a person purchases a more expensive article of clothing for a particular occasion, wears the garment, and then returns it.

SUMMARY FOR EMBODIMENTS OF THE INVENTION

Embodiments of the current invention entail a highly visible tag that can be attached to the garment at the store, but can easily be removed once the purchaser buys the garment and takes it home. Once the purchaser gets the garment home, they can remove it themselves and wear it. Once the tag is removed, it can not be reattached by the consumer. Depending on the store policy, the garment may not be returned, or there may be an extra fee for returning the garment, or other similar policies. The use of a tag makes it clear that the buyer has removed the tag and provides an indication that the garment has been worn in public.

In at least one embodiment the tag consists of an elongated plastic piece having a hinge in the middle so that it can fold over. Toward one end of the unfolded tag is a post, and at the other end, coincident with the post when the tag is folded, is an aperture through the tag. At least one flexible tab extends laterally from the post. When the tag is folded, the post inserts through the aperture. The flexible tab is located at a height on the post such that, when the post is inserted through the aperture, it is bent and passes through the aperture. After the tab is forced through the aperture, it springs back to its extended position and acts to keep the tag in its folded configuration.

In one embodiment, a tack is located between the post and its respective end and it is located on the same side and directed in the same direction as the post. At the opposite end of the unfolded tag, an aperture is located to coincide with the tack when the tag is closed. When the tag is closed over a piece of cloth, i.e. a garment, the tack passes through the garment and inserts into the aperture. The aperture may be formed by a raised rim on that side of the tag. The relative positions of the tack and aperture may be reversed.

Generally, each half of the folded tag has a rim around its edge that matches and presses against the rim of the other half when the tag is folded. However, in the area of the tack and aperture, the rim is not present. This leaves a gap that accommodates the cloth of a garment when the tag is installed on a garment.

To remove a tag from a garment or other item, the end of the tag where the post is located is squeezed. The pushes the post even further through the aperture, so that the body of the post beneath the flexible tab is exposed outside the tag. The post can then be cut beneath the flexible tab to remove the flexible tab, which is what normally retains the tag in a folded configuration. In use, the tag would be removed by the purchaser of the garment when the purchaser wears the garment in public.

In at least one embodiment the hinge between the two portions of the body of the tag is a compound hinge. The hinge folds at its middle and also where it attaches to the two portions of the body. This allows the hinge to fold into the interior of the body of the tag when the tag is in the folded configuration, and prevents access to the hinge by any who may want to tamper with the tag.

Some embodiments of the tag will enclose an EAS device. The EAS device would interact with a larger EAS system to provide security and tracking functions. The EAS device may range from passive, to semi-passive, to active. In some cases, the EAS device may actually be a dummy device which produces a rattle with the body of the tag to deceive would be thieves that an EAS device is housed in the tag. Of course, in the latter case the dummy device would not interact with the larger EAS system.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figure 1:
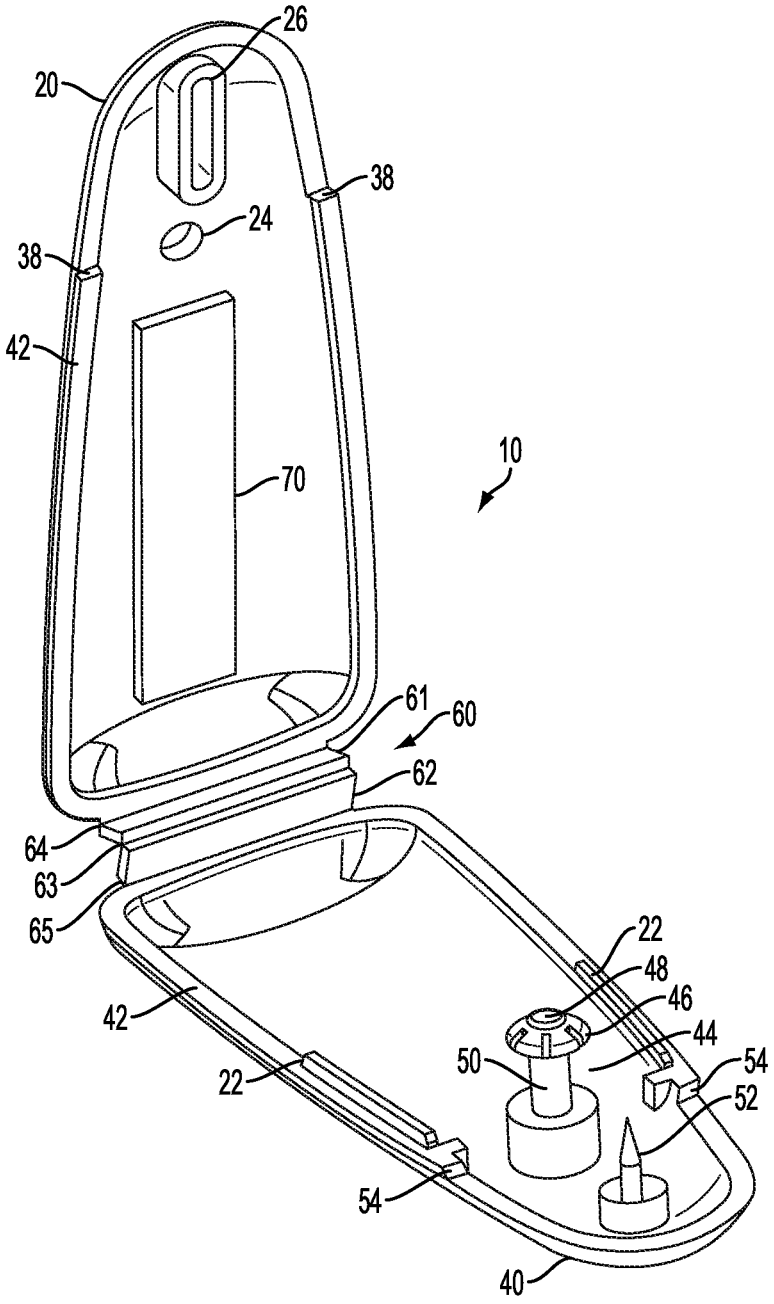
FIG. 1 is a perspective view of an embodiment the tag in an opened configuration.

FIG. 1 is a perspective view of an embodiment tag 10 in an opened configuration. In general, tag 10 comprises a top shell 20, a bottom shell 40, and a compound hinge 60 connecting top shell 20 and bottom shell 40. Top 20 and bottom 40 shells are each concave and have edges 42 generally matching each other. Compound hinge 60 is made of two panels, upper panel 61 and lower panel 62. Upper panel 61 and lower panel 62 are connected by central hinge 63 while upper panel 61 is connected to top shell 20 by upper hinge 64 and lower panel 62 is connected to bottom shell 40 by lower hinge 65. When tag 10 is folded at compound hinge 60 to bring top shell 20 together with bottom shell 40, they form a generally hollow body. See FIGS. 3 and 4. Compound hinge 60 bends at central hinge 63, upper hinge 62 and lower hinge 65 to allow upper panel 61 and lower panel 62 to fold into the interior of tag 10.

Tag 10 may have ridges 22 along the interior of edges 42 of top shell 20 or bottom shell 40 which will fit along the interior of edge 42 of its opposite shell. This provides greater rigidity when tag 10 is in the closed configuration. Both top shell 20 and bottom shell 40 have recessed steps 38 and 54 respectively at their ends to create gap 56 (See FIGS. 3, and 4) between their ends when tag 10 is closed. This leaves some space for the material of the garment when tag 10 is closed on a garment.

Post 44 is located within bottom shell 40. Post aperture 24 is located in top shell 20. Post 44 and post aperture 24 are positioned within their respective shells so that when tag 10 is closed post 44 inserts through post aperture 24. Post 44 has at least one catch tab 46 extending from its top 48. In the embodiment shown in FIGS. 1 and 3, post 44 has several catch tabs 46. Catch tabs 46 are flexible and post aperture 24, post 44, and catch tabs 46 are sized so that post 44 can insert through post aperture 24 by the flexing of catch tabs 46 down against the body 50 of post 44. When tag 10 is fully closed and top 48 of post 44 has passed through post aperture 24, catch tabs 46 extend out again. Catch tabs 46 prevent the retraction of post 44 back through post aperture 24 which keeps tag 10 closed (see FIG. 2).

To keep a closed tag 10 attached to a garment, tack 52 is located on the interior of bottom shell 40 and directed toward the concave side of bottom shell 40. Tack aperture 26 on the interior surface of top shell 20 is position to receive tack 52 when tag 10 is closed. When tag 10 is closed on a garment tack 52 passes through the garment and inserts into tack aperture 26. The keeps tag 10 attached to the garment.

Figure 2:
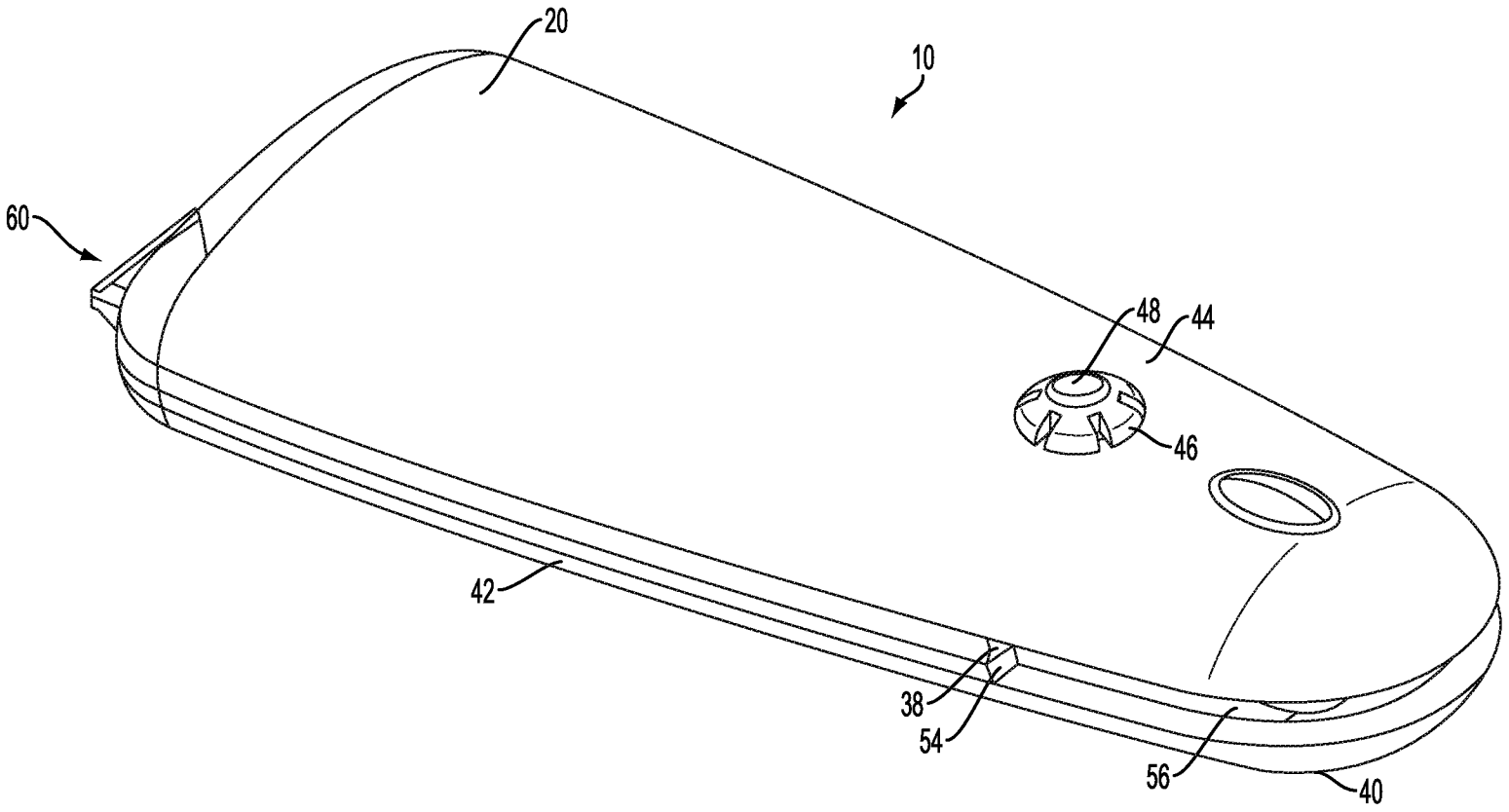
FIG. 2 is a perspective view of an embodiment the tag in a closed configuration showing the post inserted through the aperture and the flexible tabs external to the tag.

Turning now to FIG. 2, FIG. 2 is a perspective view of an embodiment of tag 10 in a closed configuration showing top 48 of post 44 inserted through post aperture 24 and catch tabs 46 external the top shell 20 of tag 10. Catch tabs 46 prevent post 44 from passing back through post aperture 24. To open tag 10 and remove it from a garment, top 48 of post 44 is cut off, including catch tabs 46. This may be accomplished by pressing the ends of top shell 20 and bottom shell 40 together to expose the body 50 of post 44 beneath catch tabs 46 for access by scissors. Alternatively, a single sharp edge could be used and slid under catch tabs 46 to cut body 50 of post 44. Some embodiments of tag 10 may also have excess height in post 44 which would inherently leave body 50 of post 44 exposed.

Figure 3:
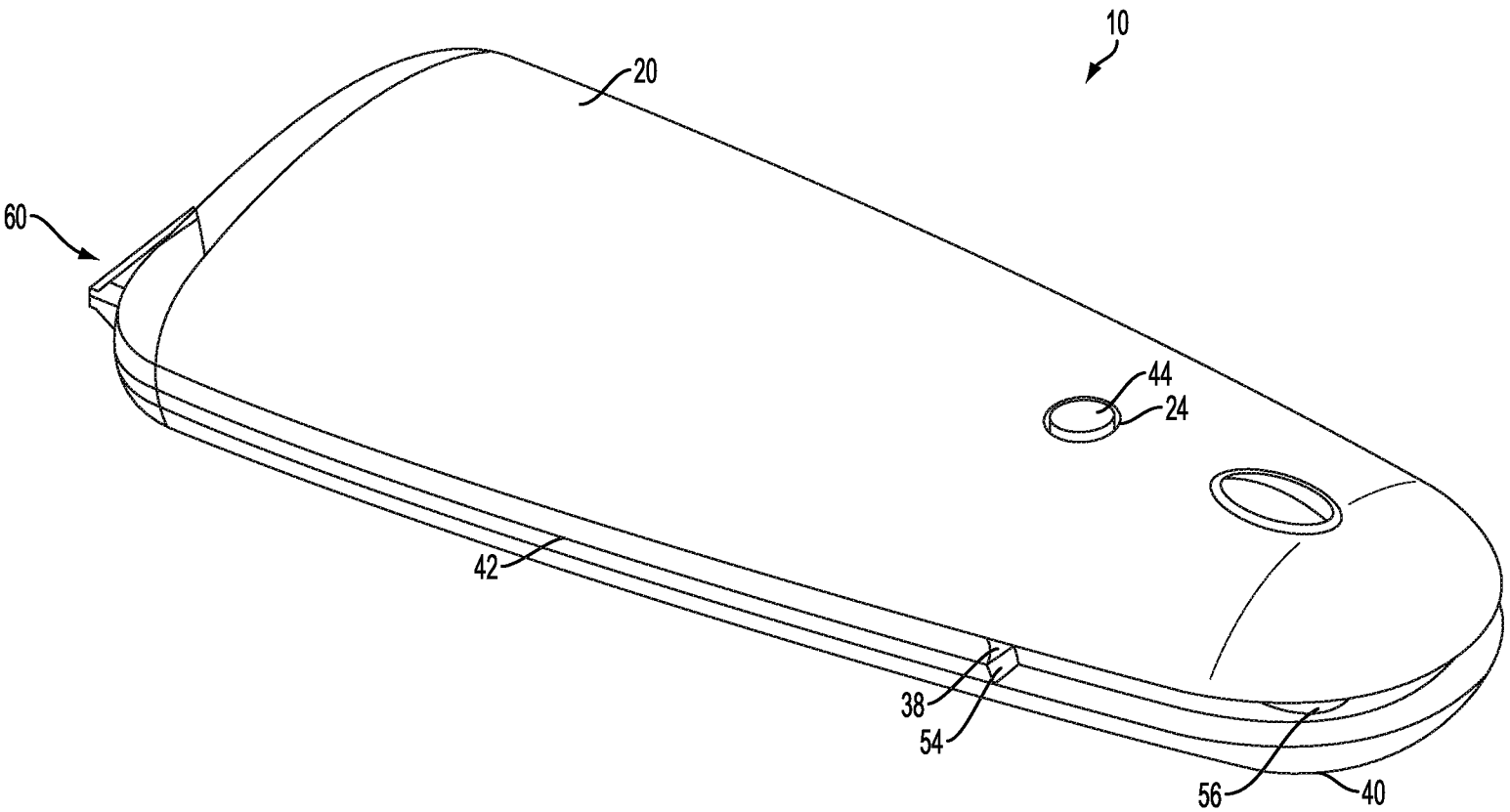
FIG. 3 is the perspective view of FIG. 2 of an embodiment the tag in a closed configuration showing the post trimmed and the flexible tabs removed.
Figure 4:
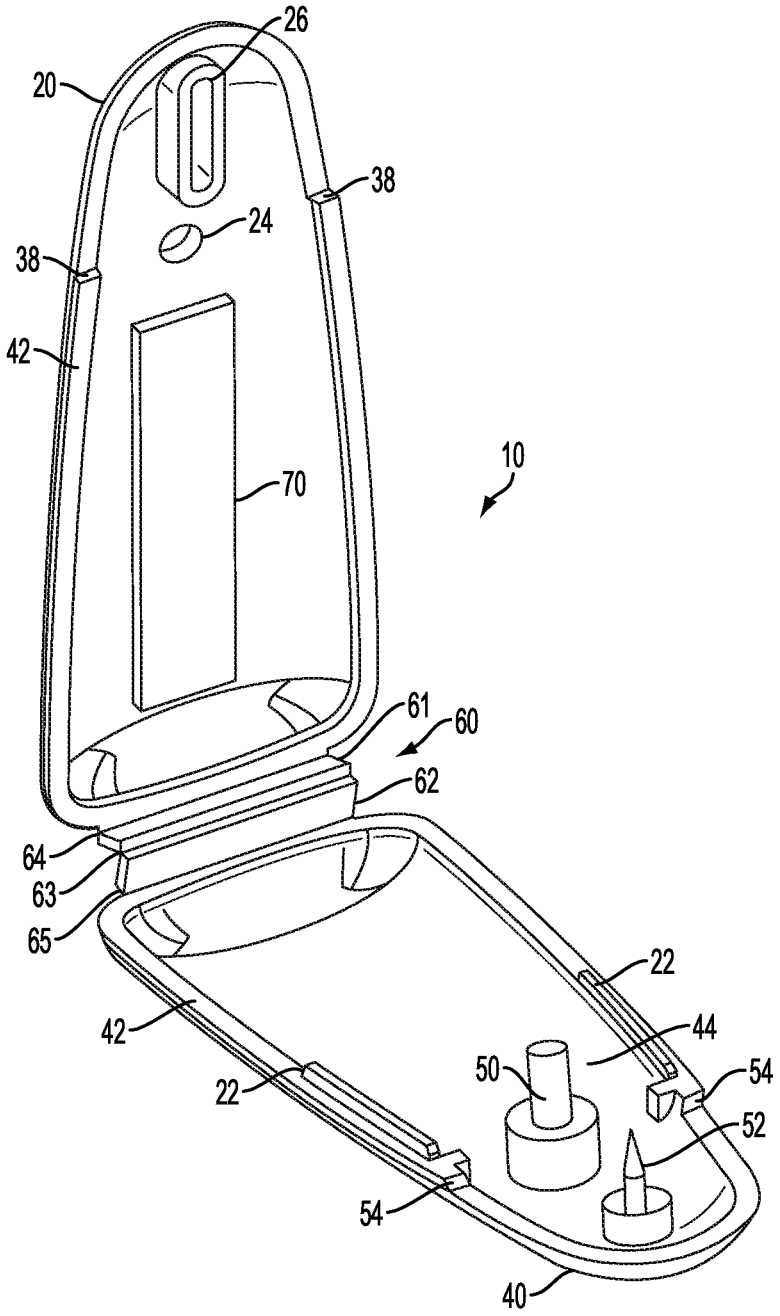
FIG. 4 is perspective view of FIG. 1 of an embodiment the tag in an opened configuration showing the post trimmed and the catch tabs removed.

FIG. 3 is the perspective view of FIG. 2 of an embodiment tag 10 in a closed configuration showing post 44 trimmed and catch tabs 48 removed. With catch tabs 48 removed, the tag 10 can be opened. When tag 10 is opened, tack 52 can be disengaged from the garment, and tag 10 removed. FIG. 4 is the perspective view of FIG. 1 of an embodiment of tag 10 in an opened configuration showing post 44 trimmed and catch tabs 48 removed.

In both FIGS. 1 and 4, EAS element 70 is visible. EAS element 70 is located on the interior surface of top shell 20. EAS element 70 may be passive, semi-passive, or active. Because tag 10 is rendered unusable in the process of removing it, it can only be used once. Because of this, for uses where tag 10 will be removed by the consumer, EAS element 70 will be as inexpensive as practicable. Some embodiments of tag 10 may actually enclose a dummy element which only rattles. For applications where tag 10 will be removed by an authorized person, EAS element 70 may be removably attached to the interior of tag 10. In those applications, the person removing tag 10 could retrieve EAS element 70 for multiple uses.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. A single use anti-theft tag, comprising:

a first shell, a second shell, and a hinge connecting said first and second shells, and an electronic article surveillance element;

said first and second shells being concave with interior surfaces and having matching edges so that when said tag is folded at said hinge and said edges of said first shell and second shell are brought together to a closed position, said tag forms an at least partially hollow interior;

said first shell comprising an aperture through it and a slot formed in its interior surface;

said second shell comprising a post extending from its interior surface, said post being topped with a catch tab extending laterally from its end, located to align with said aperture, and long enough to extend said catch tab fully through said aperture when said tag is in said closed position;

said catch tab on said post extending far enough from said post to exceed the width of said aperture and constructed to yield when said post inserts through said aperture but to resist and prevent the extraction of said post;

said second shell further comprising a tack extending from its interior surface, said tack located to insert into said slot when said tag is in said closed position;

said end of said post being severable to remove said catch tab and allow the opening of said tag; and said electronic article surveillance element being located in said at least partially hollow interior when said tag is folded at said hinge and said first shell and second shell are brought together to a closed position.

2. The single use anti-theft tag of claim 1, wherein:

said hinge is a compound hinge comprising a first panel hingedly connected to said first shell and a second panel hingedly connected to said second shell, said first and second panel being hingedly connected to each other.

3. The single use anti-theft tag of claim 2, wherein:

said first panel and said second panel fold into the interior of said tag when said tag is in said closed position.

4. The single use anti-theft tag of claim 1, wherein:

said edges of said first shell proximal to said slot are recessed and said edges of said second shell proximal to said tack are recessed, creating a gap between said first shell and said second shell about said tack when said tag is in said closed position.

5. The single use anti-theft tag of claim 1, wherein:
said first shell, said second shell, and said hinge are a single continuous piece foldable at said hinge.

* * * * *